US010019857B1

(12) United States Patent
Mcquillen et al.

(10) Patent No.: US 10,019,857 B1
(45) Date of Patent: Jul. 10, 2018

(54) HIT-AND-RUN DETECTION

(71) Applicant: Ford Global Technologies, LLC, Dearborn, MI (US)

(72) Inventors: Michael Mcquillen, Warren, MI (US); Daniel A. Makled, Dearborn, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 15/598,378

(22) Filed: May 18, 2017

(51) Int. Cl.

| | |
|---|---|
| ***G08G 1/16*** | (2006.01) |
| ***G07C 5/08*** | (2006.01) |
| ***G08G 1/017*** | (2006.01) |
| ***G07C 5/00*** | (2006.01) |
| ***G08G 1/01*** | (2006.01) |

(52) U.S. Cl.
CPC ..... *G07C 5/085* (2013.01); *G07C 5/008* (2013.01); *G08G 1/0133* (2013.01); *G08G 1/0175* (2013.01); *G08G 1/162* (2013.01)

(58) Field of Classification Search
CPC ..... B60R 25/00; B60R 25/04; G08G 1/127; G08G 1/162; G08G 1/096716; G08B 13/19647; G07C 5/008; H04N 2/181; H04N 2/18
USPC ..... 340/539.13, 436, 989, 935, 905, 903; 348/148; 705/305, 14.66
See application file for complete search history.

(56) References Cited

U.S. PATENT DOCUMENTS 6,246,323 B1 * 6/2001 Fischbach ..... B60R 25/00 340/539.13
7,069,118 B2 * 6/2006 Coletrane ..... G07C 5/008 340/436
9,102,261 B2 * 8/2015 Chang ..... B60Q 9/00
9,508,201 B2 * 11/2016 Bhogal ..... G07C 5/008
2001/0006373 A1 * 7/2001 Jeong ..... G08G 1/127 342/357.31
2006/0033615 A1 * 2/2006 Nou ..... G08B 13/19647 340/539.13
2009/0024274 A1 * 1/2009 Nagai ..... G01D 9/005 701/33.4
2009/0299857 A1 * 12/2009 Brubaker ..... G06Q 30/02 705/14.66
2012/0242511 A1 * 9/2012 Morgan ..... B60R 25/04 340/989
2012/0286974 A1 * 11/2012 Claussen ..... G08G 1/162 340/935
2014/0132404 A1 * 5/2014 Katoh ..... B60R 21/013 340/436

(Continued)

FOREIGN PATENT DOCUMENTS

CN 202870930 U 4/2013
CN 103419752 A 12/2013

(Continued)

*Primary Examiner* — Hoi Lau
(74) *Attorney, Agent, or Firm* — Frank A. MacKenzie; Bejin Bieneman PLC

(57) ABSTRACT

A computer in a first vehicle is programmed to detect a collision with a second vehicle, start a countdown timer upon detecting the collision, classify the collision as a hit-and-run with the second vehicle based on expiration of the countdown timer, and upon classifying the collision as a hit-and-run, tag the second vehicle based on at least one of receiving a vehicle-to-vehicle collision broadcast and receiving data from a sensor operable to identify the second vehicle.

18 Claims, 3 Drawing Sheets

(56) References Cited

U.S. PATENT DOCUMENTS

| | | | | |
|---|---|---|---|---|
| 2014/0218529 | A1* | 8/2014 | Mahmoud | H04N 7/181 348/148 |
| 2014/0375807 | A1* | 12/2014 | Muetzel | H04N 7/18 348/148 |
| 2015/0019447 | A1* | 1/2015 | Baughman | G06Q 10/20 705/305 |
| 2015/0244994 | A1* | 8/2015 | Jang | G06K 9/00825 348/148 |
| 2015/0310742 | A1* | 10/2015 | Albornoz | G08G 1/096716 340/905 |
| 2017/0178513 | A1* | 6/2017 | Davis | G08G 1/162 |

FOREIGN PATENT DOCUMENTS

| | | | |
|---|---|---|---|
| DE | 102010001006 | A1 | 7/2011 |
| WO | WO 2015044482 | A1 | 4/2015 |

* cited by examiner

HIT-AND-RUN DETECTION

BACKGROUND

An autonomous vehicle involved in a collision may not have a human driver able to exchange information with the driver of the other vehicle. It is typically desirable that the vehicles involved in a collision stop and park in a location that will minimize obstruction to other vehicles. If an occupant or bystander is injured and/or property damage has occurred, it is typically incumbent on a human occupant or bystander to arrange for emergency/police help and/or stay near the vehicles until the help arrives. If sufficient property damage occurs, one of the drivers must call the police. Further, information must be exchanged, such as name, address, registration number, and driver's license. Where a vehicle leaves a collision area without exchanging information, the collision is referred to as a "hit and run." Vehicles and infrastructure are not equipped to detect hit and runs.

DETAILED DESCRIPTION

Figure 1:
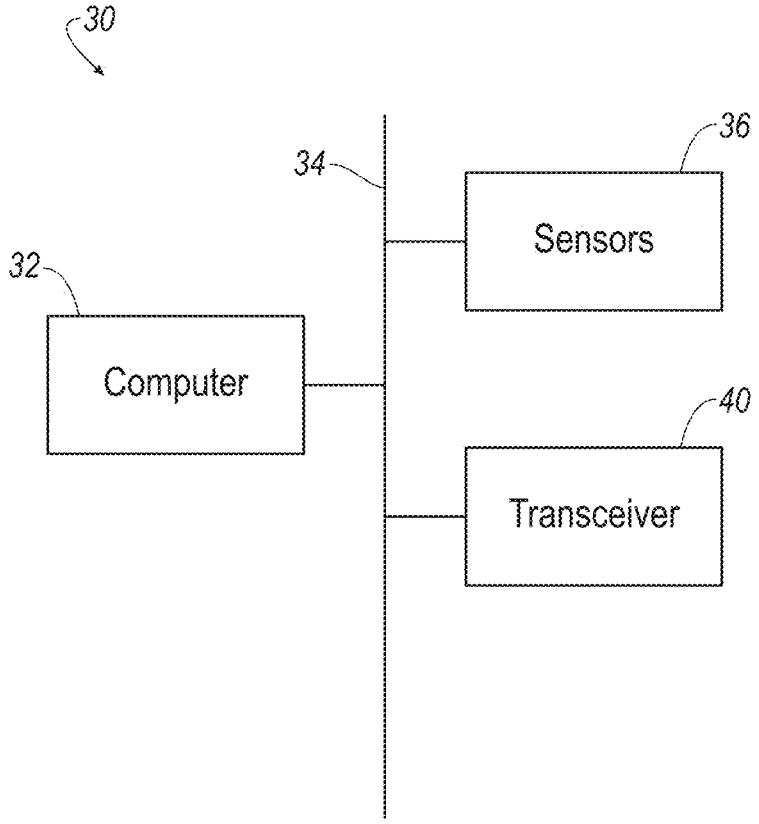
FIG. 1 is a block diagram of an exemplary first vehicle.

The system described below provides a technical solution for a vehicle to detect and report a hit and run. The system includes sensors, communications devices, and a computer in a vehicle to determine whether a hit and run has happened to the vehicle and to identify a vehicle that has hit and run. The computer is programmed to perform steps to classify collisions in which the vehicle has been involved. The system may increase the speed with which emergency help is summoned to a scene of a collision and and/or the accuracy of data related to hit-and-run incidents.

A computer in a first vehicle is programmed to detect a collision with a second vehicle, start a countdown timer upon detecting the collision, classify the collision as a hit-and-run with the second vehicle based on expiration of the countdown timer, and upon classifying the collision as a hit-and-run, tag the second vehicle based on at least one of receiving a vehicle-to-vehicle collision broadcast and receiving data from a sensor operable to identify the second vehicle.

The computer may be further programmed to record data identifying the second vehicle from the broadcast upon receiving the broadcast, and to include the data when tagging the second vehicle.

The computer may be further programmed to record data identifying the second vehicle from the sensor upon determining that the sensor is operable to identify the second vehicle, and to include the data when tagging the second vehicle. The data identifying the second vehicle may include an image of a license plate.

The computer may be further programmed to determine that the computer failed to receive predetermined data about the second vehicle, and to classify the collision as a hit-and-run upon expiration of the countdown timer without receiving the predetermined data. The computer may be further programmed to transmit a hit-and-run broadcast upon classifying the collision as a hit-and-run. The hit-and-run broadcast may include data used when tagging the second vehicle.

The computer may be further programmed to determine that the computer received predetermined data about the second vehicle, and to classify the collision as a non-hit-and-run upon receiving the predetermined data from the second vehicle.

The computer may be further programmed to transmit a vehicle-to-vehicle broadcast to a third vehicle requesting data identifying the second vehicle. The computer may be further programmed to determine that the computer received a second vehicle-to-vehicle broadcast from the third vehicle including the data identifying the second vehicle, to record the data identifying the second vehicle from the second vehicle-to-vehicle broadcast upon determining that the computer received the second vehicle-to-vehicle broadcast, and to include the data when tagging the second vehicle.

A method includes detecting a collision by a first vehicle with a second vehicle, starting a countdown timer upon detecting the collision, classifying the collision as a hit-and-run with the second vehicle based on expiration of the countdown timer, and upon classifying the collision as a hit-and-run, tagging the second vehicle based on at least one of receiving a vehicle-to-vehicle collision broadcast and receiving data from a sensor operable to identify the second vehicle.

The method may include storing data identifying the second vehicle from the broadcast upon receiving the broadcast, and including the data when tagging the second vehicle.

The method may include recording data identifying the second vehicle from the sensor upon determining that the sensor is operable to identify the second vehicle, and including the data when tagging the second vehicle. The data identifying the second vehicle may include an image of a license plate.

The method may include determining that the computer failed to receive predetermined data about the second vehicle, and classifying the collision as a hit-and-run upon expiration of the countdown timer without receiving the predetermined data. The method may include transmitting a hit-and-run broadcast upon classifying the collision as a hit-and-run. The hit-and-run broadcast may include data used when tagging the second vehicle.

The method may include determining that the computer received predetermined data from the second vehicle, and classifying the collision as a non-hit-and-run upon receiving the predetermined data from the second vehicle.

The method may include transmitting a vehicle-to-vehicle broadcast to a third vehicle requesting data identifying the second vehicle. The method may include determining that the computer received a second vehicle-to-vehicle broadcast from the third vehicle including data identifying the second vehicle, recording the data identifying the second vehicle from the second vehicle-to-vehicle broadcast upon determining that the computer received the second vehicle-to-vehicle broadcast, and including the data when tagging the second vehicle.

With reference to FIG. 1, a first vehicle 30 may be an autonomous, semi-autonomous, or nonautonomous vehicle. (The adjectives "first" and "second" are used throughout this document as identifiers and are not intended to signify importance or order.) A computer 32 in the first vehicle 30 may be capable of operating the vehicle independently of the intervention of a human driver, completely or to a lesser degree. The computer 32 may be programmed to operate the propulsion, brake system, steering, and/or other vehicle systems. Under autonomous operation, the computer 32 operates the propulsion, the brake system, and the steering. Under semi-autonomous operation, the computer 32 operates one or two of the propulsion, the brake system, and the steering, and a human driver operates the rest of the propulsion, the brake system, and the steering. Under nonautonomous operation, the human driver operates the propulsion, the brake system, and the steering.

The computer 32 is a microprocessor-based computer. The computer 32 includes a processor, memory, etc. The memory of the computer 32 may include memory for storing instructions executable by the processor as well as for electronically storing data and/or databases.

The computer 32 may transmit signals through a communications network 34 of the vehicle 30 such as a controller area network (CAN) bus, Ethernet, Local Interconnect Network (LIN), and/or any other suitable wired or wireless communications network. The computer 32 may be in communication with sensors 36, a transceiver 40, etc. via the communications network 34.

The vehicle may include the sensors 36. The sensors 36 may detect internal states of the vehicle, for example, wheel speed, wheel orientation, and engine and transmission data (e.g., temperature, fuel consumption, etc.). The sensors 36 may detect the position and/or orientation of the vehicle. For example, the sensors 36 may include global positioning system (GPS) sensors; accelerometers such as piezo-electric or microelectromechanical systems (MEMS); gyroscopes such as rate, ring laser, or fiber-optic gyroscopes; inertial measurements units (IMU); and magnetometers. The sensors 36 may detect the environment external to the vehicle 30. For example, the sensors 36 may include radar sensors, scanning laser range finders, light detection and ranging (LIDAR) devices, and image processing sensors such as cameras. The sensors 36 may be adapted to detect an impact to the first vehicle 30, for example, post-contact sensors such as linear or angular accelerometers, gyroscopes, pressure sensors, and contact switches; and pre-impact sensors such as radar, LIDAR, and vision-sensing systems. The vision systems may include one or more cameras, CCD image sensors, CMOS image sensors, etc. The sensors 36 for detecting impacts may be located at numerous points in or on the first vehicle 30.

In addition to the sensors 36, the vehicle 30 may include communications devices, for example, vehicle-to-infrastructure (V2I) or vehicle-to-vehicle (V2V) devices, such as the transceiver 40. The computer 32 may receive data from the transceiver 40 for operation of the vehicle 30, e.g., data from other vehicles 42, 44 about road conditions, e.g., road friction, about weather, etc. from a remote server. The transceiver 40 may be adapted to transmit signals wirelessly through any suitable wireless communication protocol, such as Bluetooth®, WiFi, IEEE 802.11a/b/g, other RF (radio frequency) communications, etc. The transceiver 40 may be adapted to communicate with a remote server, that is, a server distinct and spaced from the first vehicle 30. The remote server may be located outside the first vehicle 30. For example, the remote server may be associated with other vehicles 42, 44 (e.g., V2V communications), infrastructure components (e.g., V2I communications), emergency responders, mobile devices associated with the owner of the vehicle, etc.

Figure 2:
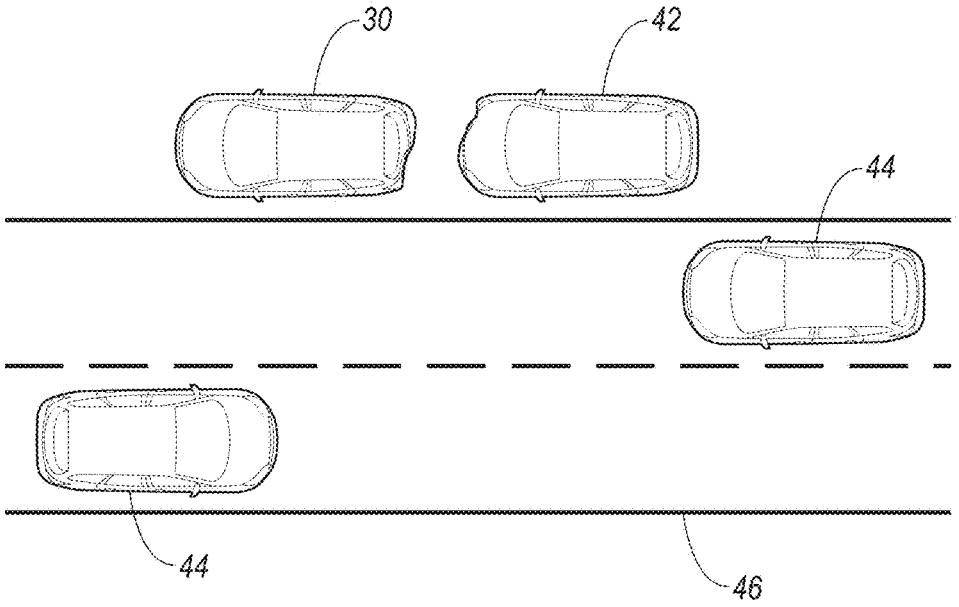
FIG. 2 is a diagram of an exemplary traffic interaction between the first vehicle and a second vehicle.

With reference to FIG. 2, the first vehicle 30 may be involved in a collision with a second vehicle 42 on a road 46. After the collision, the first vehicle 30 pulls over to a side of the road 46 to exchange information. The second vehicle 42 may also pull over, as shown in FIG. 2, or may leave the scene of the collision. Third vehicles 44 not involved in the collision may drive by on the road 46. The nature of the collision and post-collision acts may result in a different arrangement of the first vehicle 30, the second vehicle 42, and the third vehicles 44.

Figure 3:
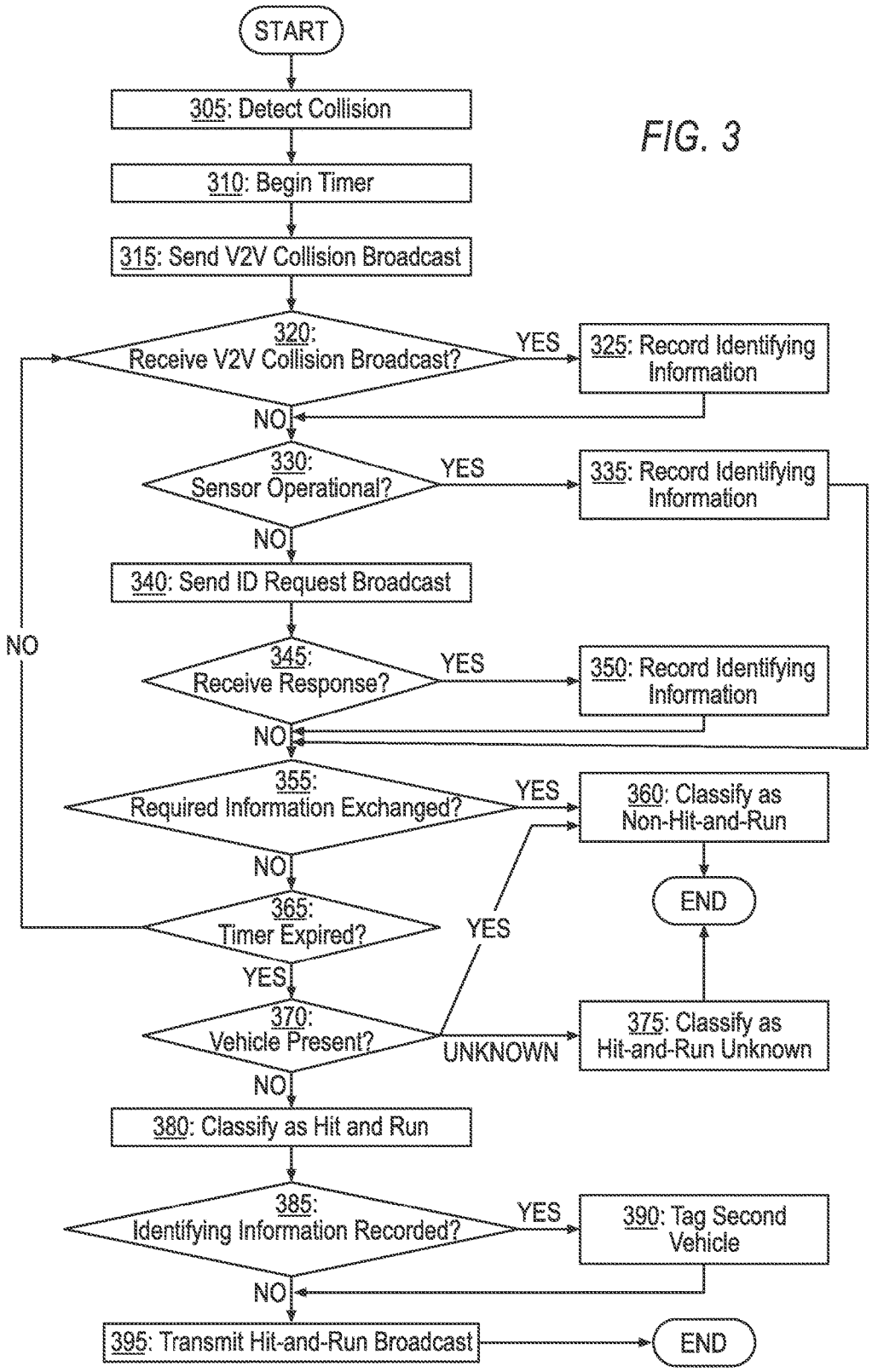
FIG. 3 is a process flow diagram illustrating an exemplary process for identifying the second vehicle after the traffic interaction.

FIG. 3 is a process flow diagram illustrating an exemplary process 300 for identifying the second vehicle 42 after the collision. The computer 32 may be programmed to perform the steps of the process 300.

The process 300 begins in a block 305, in which the computer 32 detects a collision of the first vehicle 30 with the second vehicle 42. For example, the impact sensor 38 may detect the impact and transmit a signal to the computer 32.

Next, in a block 310, upon detecting the collision, the computer 32 starts a countdown timer. The countdown timer has a preset duration, for example, ten minutes. The preset duration may be chosen to be sufficiently long for the first and second vehicles 30, 42 to pull over and park after the collision and sufficiently short that occupants of the vehicles 30, 42 (or the vehicles 30, 42 themselves) are unlikely to have exchanged predetermined data (described below with respect to a decision block 355) before expiration of the timer.

Next, in a block 315, the computer 32 sends a vehicle-to-vehicle collision broadcast. The vehicle-to-vehicle collision broadcast may include identifying data for the first vehicle 30 and/or for an owner or operator of the first vehicle 30; and/or information required to be exchanged after a collision, e.g., by law, such as name, address, registration number of the first vehicle 30, and driver's license information. The vehicle-to-vehicle collision broadcast may also include driving data from a period shortly before the collision for investigating the collision. The vehicle-to-vehicle collision broadcast may have a standardized form and data included.

Next, in a decision block 320, the computer 32 determines whether the computer 32 received a vehicle-to-vehicle collision broadcast from the second vehicle 42. If the computer 32 has not received the vehicle-to-vehicle collision broadcast from the second vehicle 42, the process 300 proceeds to a decision block 330.

If the computer 32 has received the vehicle-to-vehicle collision broadcast from the second vehicle 42, next, in a block 325, the computer 32 records data identifying the second vehicle 42, if any, from the broadcast. The data may include, e.g., a vehicle identification number (VIN), make, model, year of production, color, etc.

After the block 325 or after the block 320 if the computer 32 has not received the vehicle-to-vehicle collision broadcast from the second vehicle 42, in the decision block 330, the computer 32 identifies whether one of the sensors 36 is operable to identify the second vehicle 42. For example, the computer 32 may determine whether one of the sensors 36 is operational and has an unobstructed view of the second vehicle 42. If none of the sensors 36 is operable to identify the second vehicle 42, the process 300 proceeds to a block 340.

If the computer 32 identifies that one of the sensors 36 is operable to identify the second vehicle 42, next, in a block 335, the computer 32 records data identifying the second vehicle 42 from the one of the sensors 36 that is operable to identify the second vehicle 42. The data may include data from which the second vehicle 42 can be identified, e.g., an image of a license plate of the second vehicle 42 or images allowing identification of the make, model, year, and color of the second vehicle 42. After the block 335, the process 300 proceeds to the decision block 355.

After the decision block 330 if none of the sensors 36 are operable to identify the second vehicle 42, in a block 340, the computer 32 transmits a vehicle-to-vehicle broadcast to one of the third vehicles 44 requesting data identifying the second vehicle 42. The vehicle-to-vehicle broadcast may include data identifying the first vehicle 30 and data about the collision, e.g., time, location, precollision orientations of the first and second vehicles 30, 42, etc.

Next, in a decision block 345, the computer 32 determines whether the computer 32 received a second vehicle-to-vehicle broadcast from one of the third vehicles 44 including the data identifying the second vehicle 42. The data may include, e.g., an image of a license plate of the second vehicle 42 or images allowing identification of the make, model, year, and color of the second vehicle 42. The computer 32 may determine that the computer 32 has not received the second vehicle-to-vehicle broadcast by receiving a vehicle-to-vehicle broadcast indicating that the third vehicle did not have the data or by not receiving any response within a preset duration. The preset duration may be chosen based on typical time to respond to vehicle-to-vehicle broadcasts. If the computer 32 determines that the computer 32 has not received the second vehicle-to-vehicle broadcast, the process 300 proceeds to the decision block 355.

If the computer 32 receives the second vehicle-to-vehicle broadcast from the third vehicle, in a block 350, the computer 32 records the data identifying the second vehicle 42 from the second vehicle-to-vehicle broadcast. The data may include, e.g., an image of a license plate of the second vehicle 42 or images allowing identification of the make, model, year, and color of the second vehicle 42.

After the block 335, or after the decision block 345 if the computer 32 has not received the second vehicle-to-vehicle broadcast, or after the block 350, in the decision block 355, the computer 32 determines whether the computer 32 received predetermined data about the second vehicle 42. The predetermined data is typically information exchanged after a collision, such as name, address, registration number of the second vehicle 42, and driver's license information. The computer 32 may be programmed with categories necessarily included in the predetermined data. The computer 32 may determine that the computer 32 has received the predetermined data based on detecting that data fulfilling all the categories of the predetermined data were included in the vehicle-to-vehicle collision broadcast from the second vehicle 42, if received. The computer 32 may determine that the computer 32 has received the predetermined data based on an input from an occupant of the first vehicle 30, e.g., if the required information was manually exchanged. If the computer 32 does not receive the predetermined data, the process 300 proceeds to a decision block 365.

If the computer 32 receives the predetermined data from the second vehicle 42, next, in a block 360, the computer 32 classifies the collision as a non-hit-and-run. After the block 360, the process 300 ends.

After the block 355 if the computer 32 has not received the predetermined data, in a decision block 365, the computer 32 determines whether the countdown timer has expired. If the countdown timer has not expired, the process 300 proceeds back to the decision block 320 to repeat the blocks 320-360; in other words, the computer 32 may continue to check for the vehicle-to-vehicle collision broadcast from the second vehicle 42, continue to check for sensors 36 operational to identify the second vehicle 42, and continue to request data from third vehicles 44 until the countdown timer expires.

If the countdown timer has expired, next, in a decision block 370, the computer 32 determines whether the second vehicle 42 is still present, in other words, stopped near, i.e., within a line-of-sight, of the first vehicle 30. The computer 32 may use signals from the sensors 36 to determine whether the second vehicle 42 is within view of any of the sensors 36. If the second vehicle 42 is still present, the process 300 proceeds back to the block 360. If the second vehicle 42 is absent, the process 300 proceeds to a block 380.

If the computer 32 cannot determine whether the second vehicle 42 is still present (e.g., because some or all the sensors 36 are not operational), next, in a block 375, the computer 32 classifies the collision as hit-and-run unknown. After the block 375, the process 300 ends.

After the decision block 370, if the second vehicle 42 is absent, in the block 380, the computer 32 classifies the collision as a hit-and-run.

Next, in a decision block 385, the computer 32 determines whether the computer 32 has received data identifying the second vehicle 42. If received, the data may have been recorded as described in blocks 325, 335, or 350. If the computer 32 has not received data identifying the second vehicle 42, the process 300 proceeds to a block 395.

If the computer 32 has received data identifying the second vehicle 42, next, in a block 390, the computer 32 tags the second vehicle 42, that is, stores an identifier for the second vehicle 42, and all or some of the data gathered about the second vehicle 42 is associated with the identifier for the second vehicle 42. The identifier may be any unique or substantially unique label for the second vehicle 42, e.g., VIN, license plate number, a number arbitrarily assigned by the computer 32, etc. The data gathered from the vehicle-to-vehicle collision broadcast from the second vehicle 42, from the sensors 36, and from any vehicle-to-vehicle broadcasts from third vehicles 44 is included when tagging the second vehicle 42.

After the decision block 385, if the computer 32 has not received data identifying the second vehicle 42, or after the block 390, next, in the block 395, the computer 32 transmits a hit-and-run broadcast. The hit-and-run broadcast includes, if available, the data used when tagging the second vehicle 42, that is, the data associated with the identifier for the second vehicle 42. The hit-and-run broadcast may be transmitted to, e.g., law enforcement, an insurance company associated with the first vehicle 30, etc. After the block 390, the process 300 ends.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computing devices generally include computer-executable instructions, where the instructions may be executable by one or more computing devices such as those listed above. Computer executable instructions may be compiled or interpreted from computer programs created using a variety of programming languages and/or technologies, including, without limitation, and either alone or in combination, Java™, C, C++, Matlab, Simulink, Stateflow, Visual Basic, Java Script, Perl, HTML, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in a computing device is generally a collection of data stored on a computer readable medium, such as a storage medium, a random access memory, etc.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a ECU. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

In the drawings, the same reference numbers indicate the same elements. Further, some or all of these elements could be changed. With regard to the media, processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A computer in a first vehicle comprising a processor and a memory storing computer program instructions executable by the processor, wherein the memory, the computer program, and the processor are configured to cause the computer to:

detect a collision with a second vehicle;

start a countdown timer upon detecting the collision;

classify the collision as a hit-and-run with the second vehicle based on expiration of the countdown timer;

transmit a vehicle-to-vehicle broadcast to a third vehicle requesting that the third vehicle provide data identifying the second vehicle; and upon classifying the collision as a hit-and-run, tag the second vehicle based on at least one of receiving a vehicle-to-vehicle collision broadcast and receiving data from a sensor operable to identify the second vehicle.

2. The computer of claim 1, wherein the memory, the computer program, and the processor are further configured to record data identifying the second vehicle from the broadcast upon receiving the broadcast, and to include the data when tagging the second vehicle.

3. The computer of claim 1, wherein the memory, the computer program, and the processor are further configured to record data identifying the second vehicle from the sensor upon determining that the sensor is operable to identify the second vehicle, and to include the data when tagging the second vehicle.

4. The computer of claim 3, wherein the data identifying the second vehicle includes an image of a license plate.

5. The computer of claim 1, wherein the memory, the computer program, and the processor are further configured to determine that the computer failed to receive predetermined data about the second vehicle, and to classify the collision as a hit-and-run upon expiration of the countdown timer without receiving the predetermined data.

6. The computer of claim 5, wherein the memory, the computer program, and the processor are further configured to transmit a hit-and-run broadcast upon classifying the collision as a hit-and-run.

7. The computer of claim 6, wherein the hit-and-run broadcast includes data used when tagging the second vehicle.

8. The computer of claim 1, wherein the memory, the computer program, and the processor are further configured to determine that the computer received predetermined data about the second vehicle, and to classify the collision as a non-hit-and-run upon receiving the predetermined data from the second vehicle.

9. The computer of claim 1, wherein the memory, the computer program, and the processor are further configured to determine that the computer received a second vehicle-to-vehicle broadcast from the third vehicle including the data identifying the second vehicle, to record the data identifying the second vehicle from the second vehicle-to-vehicle broadcast upon determining that the computer received the second vehicle-to-vehicle broadcast, and to include the data when tagging the second vehicle.

10. A method comprising:

detecting a collision by a first vehicle with a second vehicle;

starting a countdown timer upon detecting the collision;

classifying the collision as a hit-and-run with the second vehicle based on expiration of the countdown timer;

transmitting a vehicle-to-vehicle broadcast to a third vehicle requesting that the third vehicle provide data identifying the second vehicle; and upon classifying the collision as a hit-and-run, tagging the second vehicle based on at least one of receiving a vehicle-to-vehicle collision broadcast and receiving data from a sensor operable to identify the second vehicle.

11. The method of claim 10, further comprising storing data identifying the second vehicle from the broadcast upon receiving the broadcast, and including the data when tagging the second vehicle.

12. The method of claim 10, further comprising recording data identifying the second vehicle from the sensor upon determining that the sensor is operable to identify the second vehicle, and including the data when tagging the second vehicle.

13. The method of claim 12, wherein the data identifying the second vehicle includes an image of a license plate.

14. The method of claim 10, further comprising determining that the computer failed to receive predetermined data about the second vehicle, and classifying the collision as a hit-and-run upon expiration of the countdown timer without receiving the predetermined data.

15. The method of claim 14, further comprising transmitting a hit-and-run broadcast upon classifying the collision as a hit-and-run.

16. The method of claim 15, wherein the hit-and-run broadcast includes data used when tagging the second vehicle.

17. The method of claim 10, further comprising determining that the computer received predetermined data from the second vehicle, and classifying the collision as a non-hit-and-run upon receiving the predetermined data from the second vehicle.

18. The method of claim 10, further comprising determining that the computer received a second vehicle-to-vehicle broadcast from the third vehicle including data identifying the second vehicle, recording the data identifying the second vehicle from the second vehicle-to-vehicle broadcast upon determining that the computer received the second vehicle-to-vehicle broadcast, and including the data when tagging the second vehicle.

* * * * *